US010485306B1

(12) United States Patent
Lovato

(10) Patent No.: US 10,485,306 B1
(45) Date of Patent: Nov. 26, 2019

(54) QUICK RELEASE SYSTEM FOR BODY ARMOR

(71) Applicant: Duraflex Hong Kong Limited, Hong Kong (CN)

(72) Inventor: Attilio Lovato, Turin (IT)

(73) Assignee: Duraflex Hong Kong Limited, Hong Kong (CN)

( * ) Notice: Subject to any disclaimer, the term of this patent is extended or adjusted under 35 U.S.C. 154(b) by 78 days.

(21) Appl. No.: 15/976,166

(22) Filed: May 10, 2018

(51) Int. Cl.
*A44B 11/25* (2006.01)

(52) U.S. Cl.
CPC ..... *A44B 11/2592* (2013.01); *A44D 2211/00* (2013.01)

(58) Field of Classification Search
CPC ..... A44B 11/2592; A44B 11/2549; A44D 2211/00; Y10T 24/45613; Y10T 24/45618; E05B 65/0003
See application file for complete search history.

(56) References Cited

U.S. PATENT DOCUMENTS 1,252,252 A * 1/1918 Doriate ..... B60R 22/105 297/484
2,832,120 A * 4/1958 Jayet ..... B64D 17/32 24/632
8,181,318 B2 5/2012 Anscher
2013/0139287 A1 6/2013 Dovner et al.
2015/0196111 A1 7/2015 Lee et al.
2016/0000191 A1 1/2016 Haider et al.

FOREIGN PATENT DOCUMENTS

CN 101715538 A 5/2010
JP 2001-120705 A 5/2001
WO 2011/068693 A2 6/2011

OTHER PUBLICATIONS

English Translation of The International Search Report and the Written Opinion of the International Searching authority, or the Declaration, dated Mar. 29, 2019 in Application No. PCT/CN2019/075665.

* cited by examiner

*Primary Examiner* — Robert Sandy
(74) *Attorney, Agent, or Firm* — Collard & Roe, P.C.

(57) ABSTRACT

A closure system has a main body having a hollow cavity, a locking mechanism slidably disposed within the cavity, and a plurality of fastening elements. The locking mechanism is formed of a central post, a plurality of engagement pins connected to the central post, and an actuator, such that pulling the actuator causes the locking mechanism to move between a locked and unlocked position. Each fastening element has an aperture for connecting to the locking mechanism by inserting the fastening element into the cavity while the locking mechanism is in the unlocked position, and then pushing the actuator to slide the locking mechanism into the locked position. All of the fastening elements can then be released simultaneously from the locking mechanism by pulling the actuator to slide the locking mechanism from the locked position to the unlocked position.

16 Claims, 9 Drawing Sheets

QUICK RELEASE SYSTEM FOR BODY ARMOR

BACKGROUND OF THE INVENTION

1. Field of the Invention

The present invention relates to a quick release system for body armor. In particular, the invention relates to a closure system that can release a person from body armor such as a multi-piece tactical vest with a single pull on a release element of the closure system.

2. The Prior Art

When wearing body armor, it is often necessary to remove the armor quickly, such as when entering water. Many body armor systems require the release of several different buckles or closures, which can be too difficult to accomplish while the user is moving. It would be desirable to provide a system where all of the pieces of body armor can be released from each other with a single action requiring the use of only one hand.

SUMMARY OF THE INVENTION

These and other objects are accomplished by a closure system comprising a main body having a hollow cavity therein, a locking mechanism slidably disposed within the cavity, and a plurality of fastening elements configured for connecting to the locking mechanism. The locking mechanism is formed of a central post, a plurality of engagement pins connected to the central post, and an actuator at one end of the central post that extends through an opening in one end of the main body, such that pulling the actuator causes the locking mechanism to slide within the main body to reach an unlocked position, and pushing the actuator causes the locking mechanism to slide to a locked position. The actuator preferably has a hole or a slot therethrough to facilitate attachment of a strap or handle.

Each fastening element has an aperture therethrough so that the fastening element can be connected to the locking mechanism by inserting the fastening element into the cavity while the locking mechanism is in the unlocked position, and then pushing the actuator to slide the locking mechanism into the locked position wherein a corresponding one of the pins extends through the aperture. All of the fastening elements can then be released simultaneously from the locking mechanism by pulling the actuator to slide the locking mechanism from the locked position to the unlocked position. This causes the engagement pins to pull out of the apertures to release the fastening elements from the locking mechanism and main body.

The main body is preferably formed from a base plate and a removable cover, so that the locking mechanism can be placed on the base plate and the cover secured over both, to maintain the locking mechanism within the main body. The cover can be removable, or can be permanently secured to the base plate. The cover has openings configured for receiving the fastening elements, so that the fastening elements are inserted into the openings to receive the engagement pins from the locking mechanism inside.

The base plate preferably has plurality of slots along peripheral edges, for accommodating webbing. In use, the base plate is secured to a section of an item, such as a tactical vest, and the fastening elements are secured to the other sections. The fastening elements are then connected to the locking mechanism, to fully assemble the item. When used on a tactical vest, once all of the fastening elements are secured, the vest is fully assembled on the wearer. A single pull on the actuator then releases the fastening elements and thus the sections of the vest, so that the wearer is fully released from the vest.

In a preferred embodiment, each fastening element is formed by a locking segment containing the aperture, and a ring connected to the locking segment. The ring has a central opening that is oriented perpendicular to the aperture. The ring can be connected to a strap that is secured to a section of the vest to connect the vest sections together. In one scenario, the locking mechanism has four engagement pins and there are four fastening elements. This enables a vest to be configured in five different sections, all of which can be released from each other by a single action. The engagement pins and the aperture in the locking segment are preferably round in cross-section, but other shapes could also be used.

In a preferred embodiment of the locking mechanism, each engagement pin is oriented to be parallel to the central post and has a free end facing away from the actuator. There is a holding element attached to the central post of the locking mechanism below each engagement pin and spaced from the engagement pin to allow passage of one of the fastening elements therebetween. The holding elements support the fastening elements and hold them in place during assembly of the closure system, prior to movement of the locking mechanism into the locked position. This allows all of the fastening elements to be properly placed before locking. Preferably, each holding element is elastically connected to the central post.

To assist in the quick release of the fastening elements from the main body, the locking segment of each fastening element is preferably configured with slanted side walls on the sides that run perpendicular to an axis of the aperture. These slanted side walls slide along the openings in the cover, which are correspondingly shaped. This shape also helps to guide the fastening elements into a proper locking position when being attached to the locking mechanism.

The locking segment preferably has rounded edges on the sides that run parallel to the axis of the aperture.

To help indicate whether the locking mechanism is in a locked or unlocked position, the main body has a slot in a top surface thereof, and the locking mechanism has a protrusion extending through the slot. In the unlocked position, the protrusion is disposed at one end of the slot, and in the locked position, the protrusion is disposed at an opposite end of the slot. The slot can also be labeled at each end to indicate the status. The protrusion and slot also help to hold the locking mechanism in place inside the main body.

In one embodiment, the end of the central post of the locking mechanism opposite the actuator abuts an end of the cavity and extends through a slot in an end of the base body when the locking mechanism is in the locked position. The locking mechanism can be slid out of this end to remove it from the main body by depressing the protrusion so that it clears the slot on the main body.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
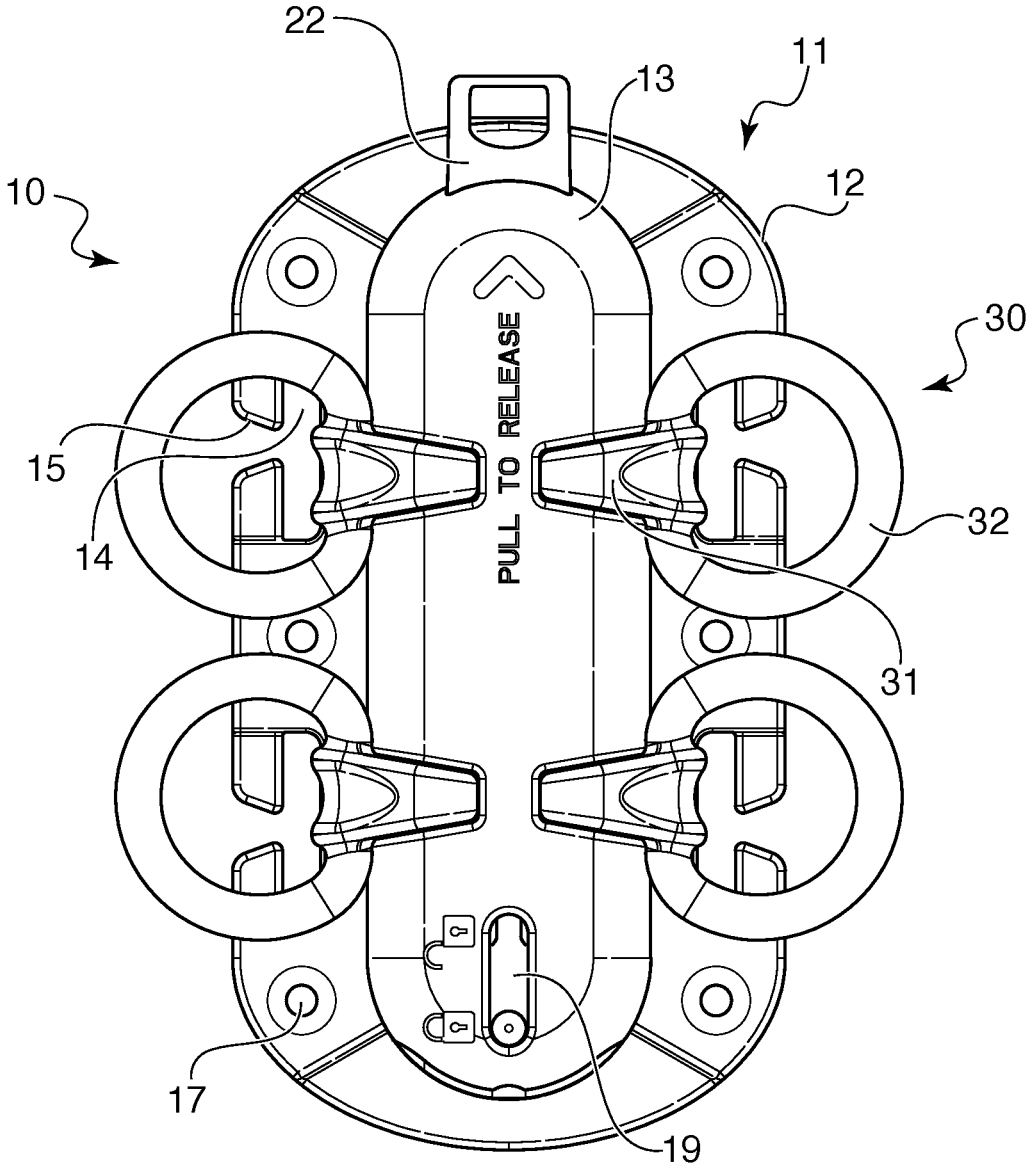
FIG. 1 shows a front view of the closure system in a fully locked position.

Referring now in detail to the drawings, FIG. 1 shows the closure system 10 according to the invention. Closure system 10 consists of three different parts: a main body 11, a locking mechanism 20, and a fastening element 30. Main body 11 consists of a base plate 12 connected to a cover 13, so that a cavity is formed between the base plate 12 and cover 13.

Figure 2:
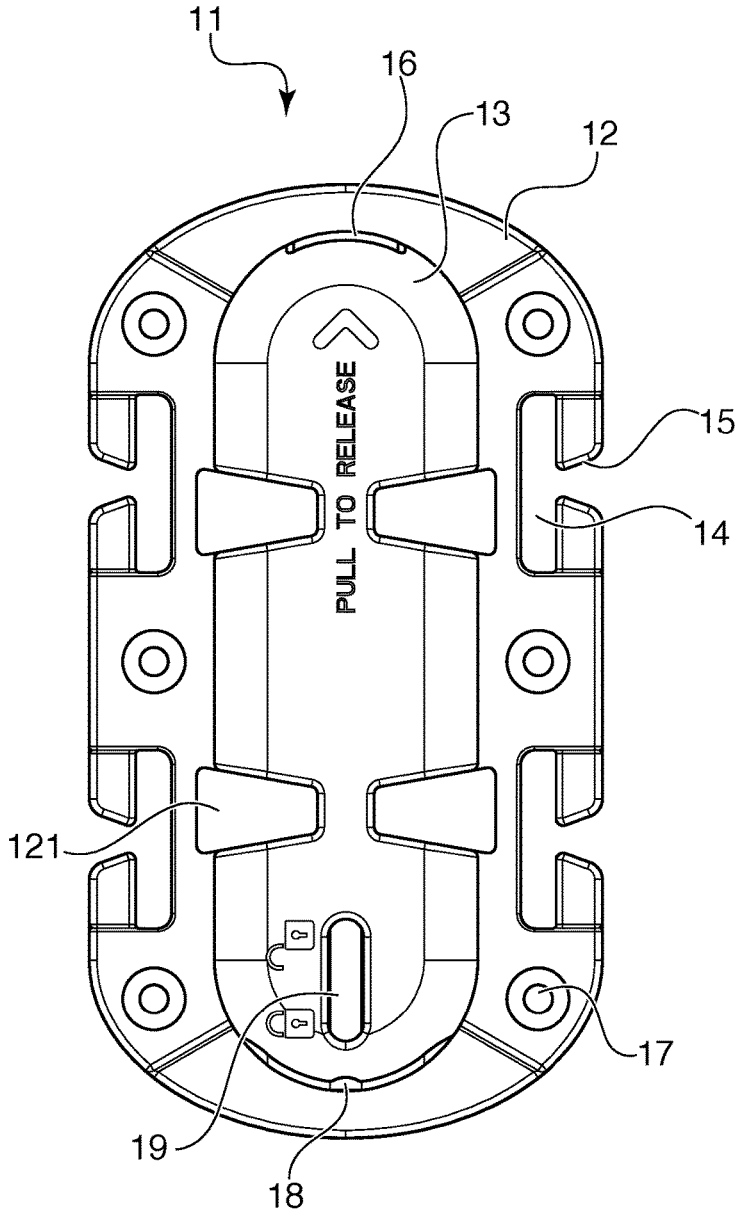
FIG. 2 shows a front view of the main body.
Figure 3:
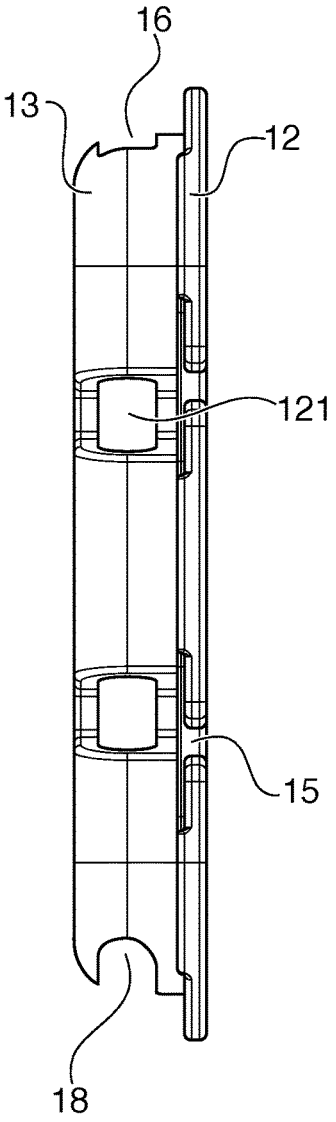
FIG. 3 shows a side view of the main body.

As shown in FIGS. 2 and 3, base plate 12 of main body 11 has a slot 14 with an accessible opening 15, to allow a strap to be threaded behind the base plate 12 to secure closure system 10 to an item such as a tactical vest. In addition, holes 17 are provided for permanently attaching closure system 10 to an item, such as by rivets, sewing or other means.

Cover 13 of main body 11 is provided with trapezoidal shaped openings 121 for receiving fastening elements 30, as shown in FIG. 1. In addition, as shown in FIGS. 2 and 3, there is an opening 16 on the top for receiving actuator 22 of locking mechanism 20, and an opening 18 on the bottom for receiving end 26.

Figure 4:
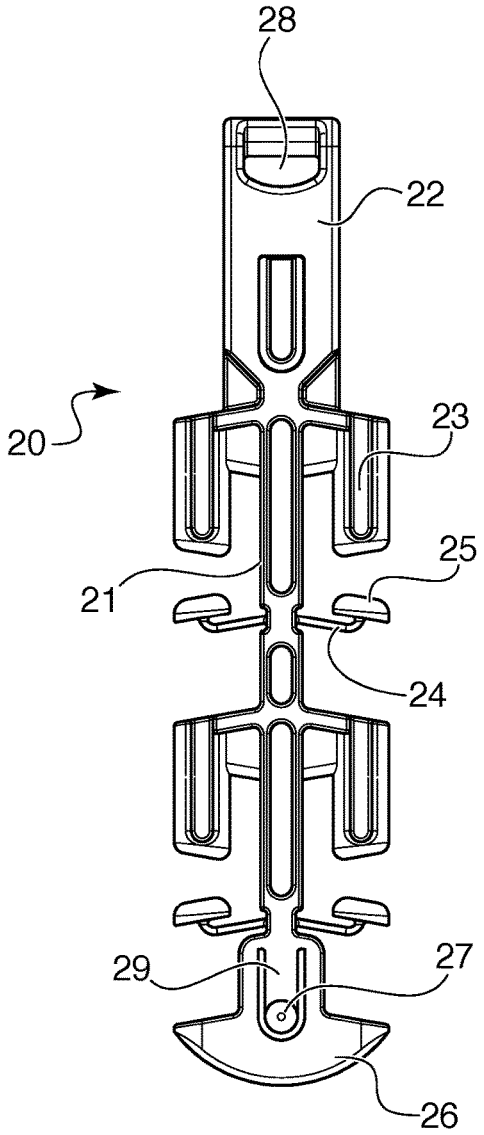
FIG. 4 shows a front view of the locking mechanism.

The components of locking mechanism 20 are shown in FIG. 4. locking mechanism 20 consists of a central post 21 having an actuator 22 on one end, and a plurality of engagement pins 23 mounted to run parallel with central post 21, and face away from actuator 22. Adjacent end 26 opposite from actuator 22, is a lever 29 holding a protrusion 27, which indicates the status of locking mechanism 20 within main body 11, and also serves to secure locking mechanism within main body 11. As shown in FIG. 1, locking mechanism 20 can slide between a locked position and an unlocked position, which causes protrusion 27 to slide between the two ends of slot 19 in cover 13. Depressing protrusion 27 allows locking mechanism 20 to be released from main body 11 by sliding it out aperture 18.

A holding element formed by support 24 and pad 25 is mounted beneath each engagement pin 23. Pad 25 holds each fastening element in place during insertion of the fastening elements into main body 11 when locking mechanism 20 is in the unlocked position, allowing proper placement of all of the fastening elements prior to locking.

Figure 5:
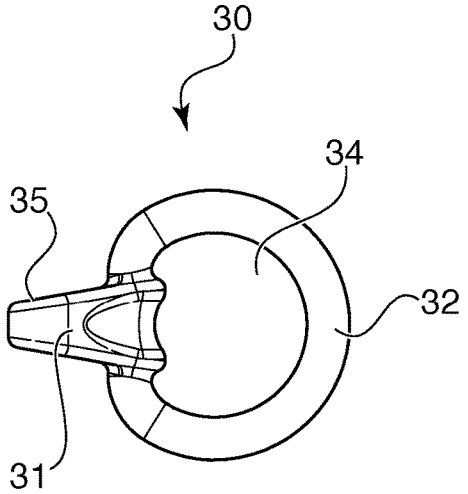
FIG. 5 shows a front view of one of the fastening elements.
Figure 6:
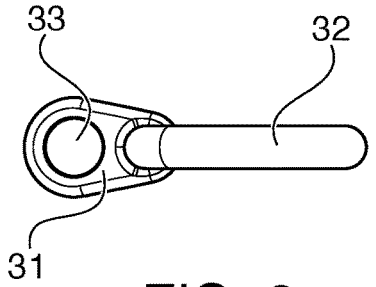
FIG. 6 shows a side view of the fastening element of FIG. 5.

Fastening element 30 is shown in detail in FIGS. 5 and 6. Fastening element 30 is formed of a locking segment 31 connected to a ring 32 having a central opening 34. Ring 32 can be connected to a strap or other device to attach the strap or device to closure system 10. Locking segment 31 has an aperture 33 that is sized to correspond to the circumference of engagement pins 23 on locking mechanism 20. Locking segment 31 also has a trapezoidal shape, with sloped side walls 35, which correspond to the trapezoidal shape of openings 121 on cover 13 of main body 11. When viewed from the side as in FIG. 6, locking segment 31 has a round cross-section, following the contour of aperture 33.

Figure 7:
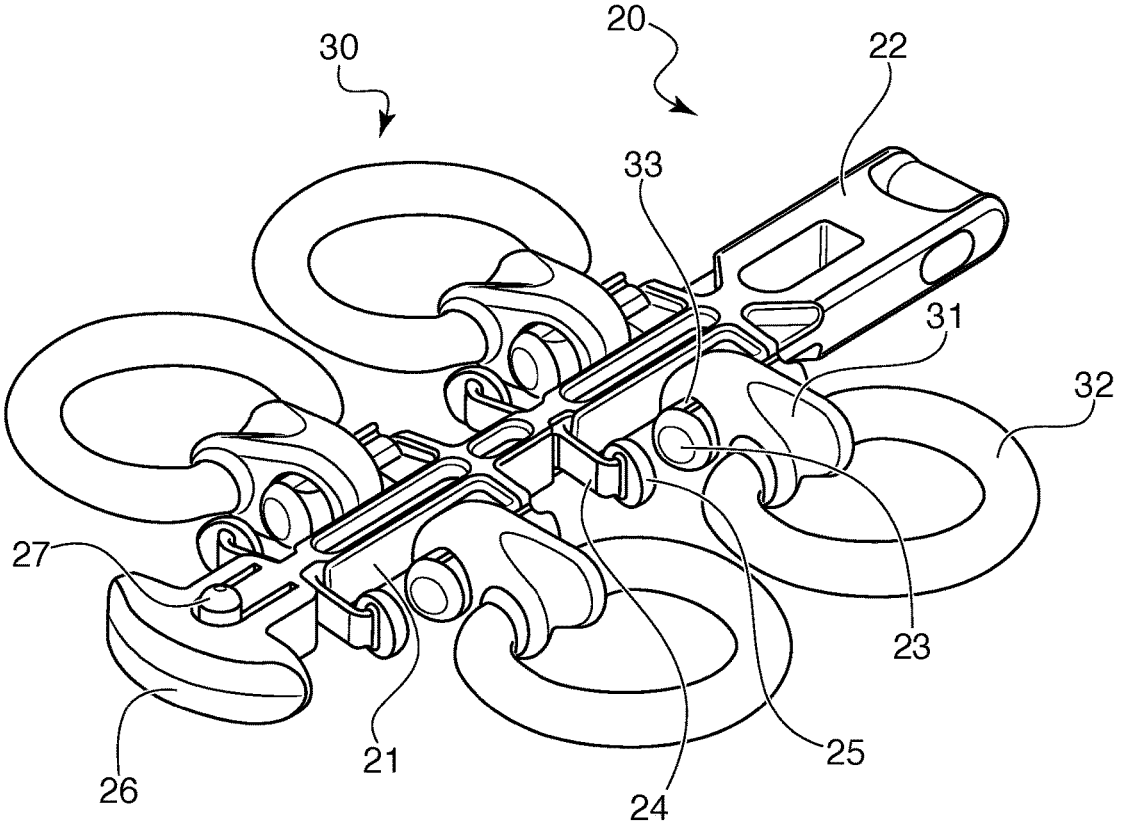
FIG. 7 shows the locking mechanism with four fastening elements attached in what would be the locked position, with the main body removed.

The orientation of fastening elements 30 on locking mechanism 20 is shown in FIG. 7. As can be seen, engagement pins 23 fit through apertures 33 in locking segments 31 of fastening elements 30. The arrangement shown in FIG. 7 is of the locking mechanism in the locked position, where it retains fastening elements 30 securely thereon.

Figure 8:
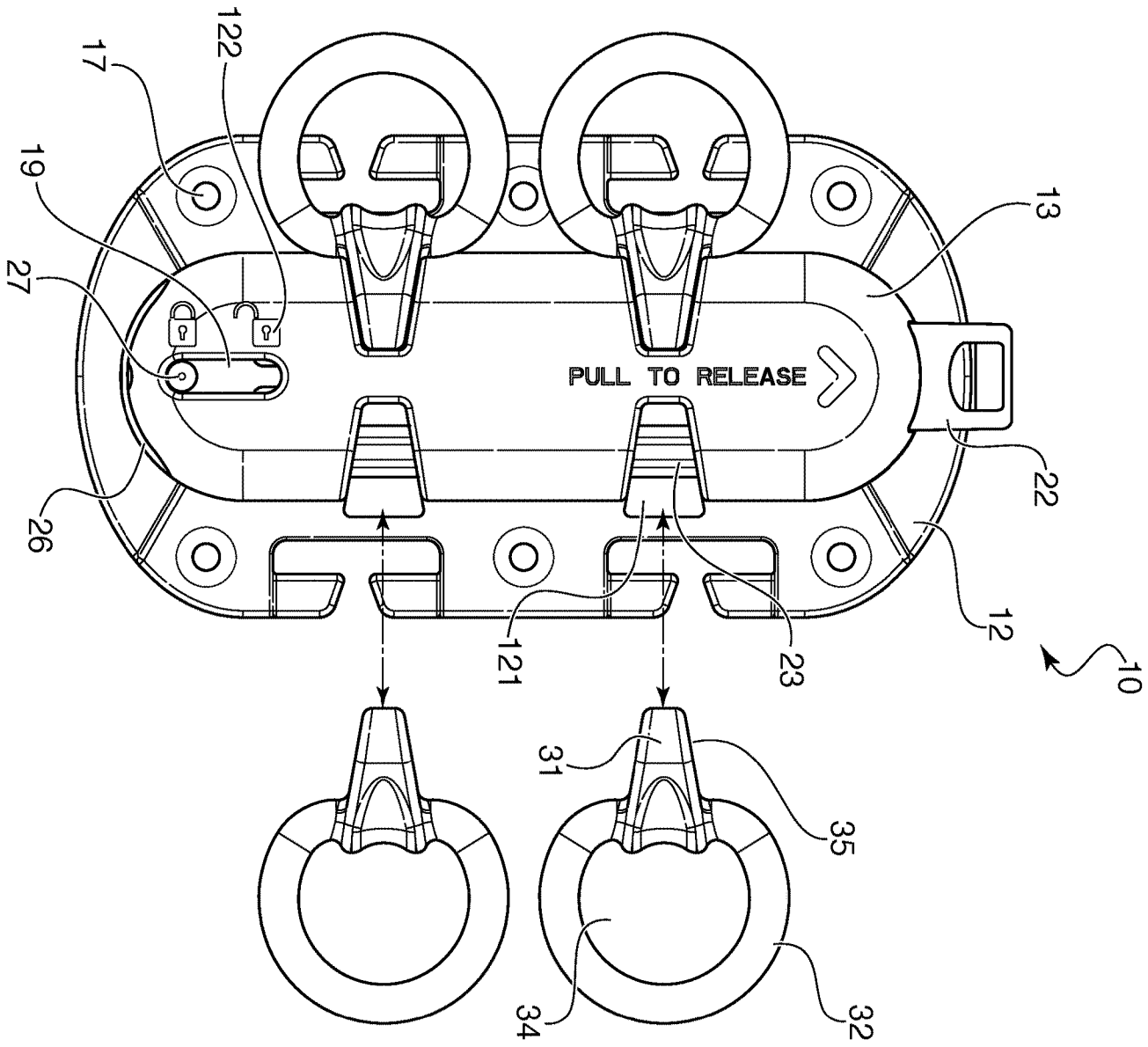
FIG. 8 shows a front view of the closure system with two fastening elements attached, in the locked position.
Figure 9:
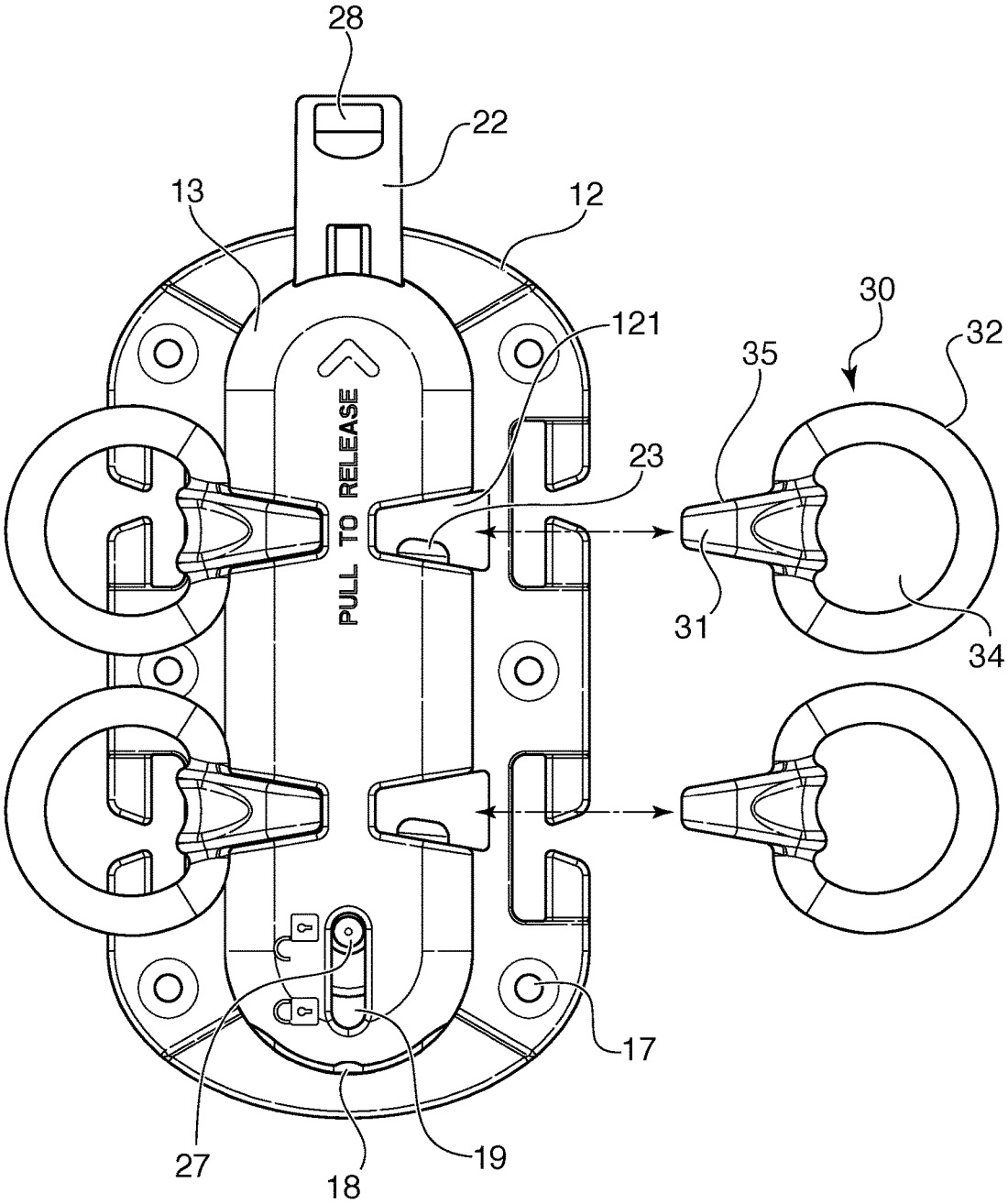
FIG. 9 shows a front view of the closure system with two fastening elements attached, in the unlocked position.
Figure 10:
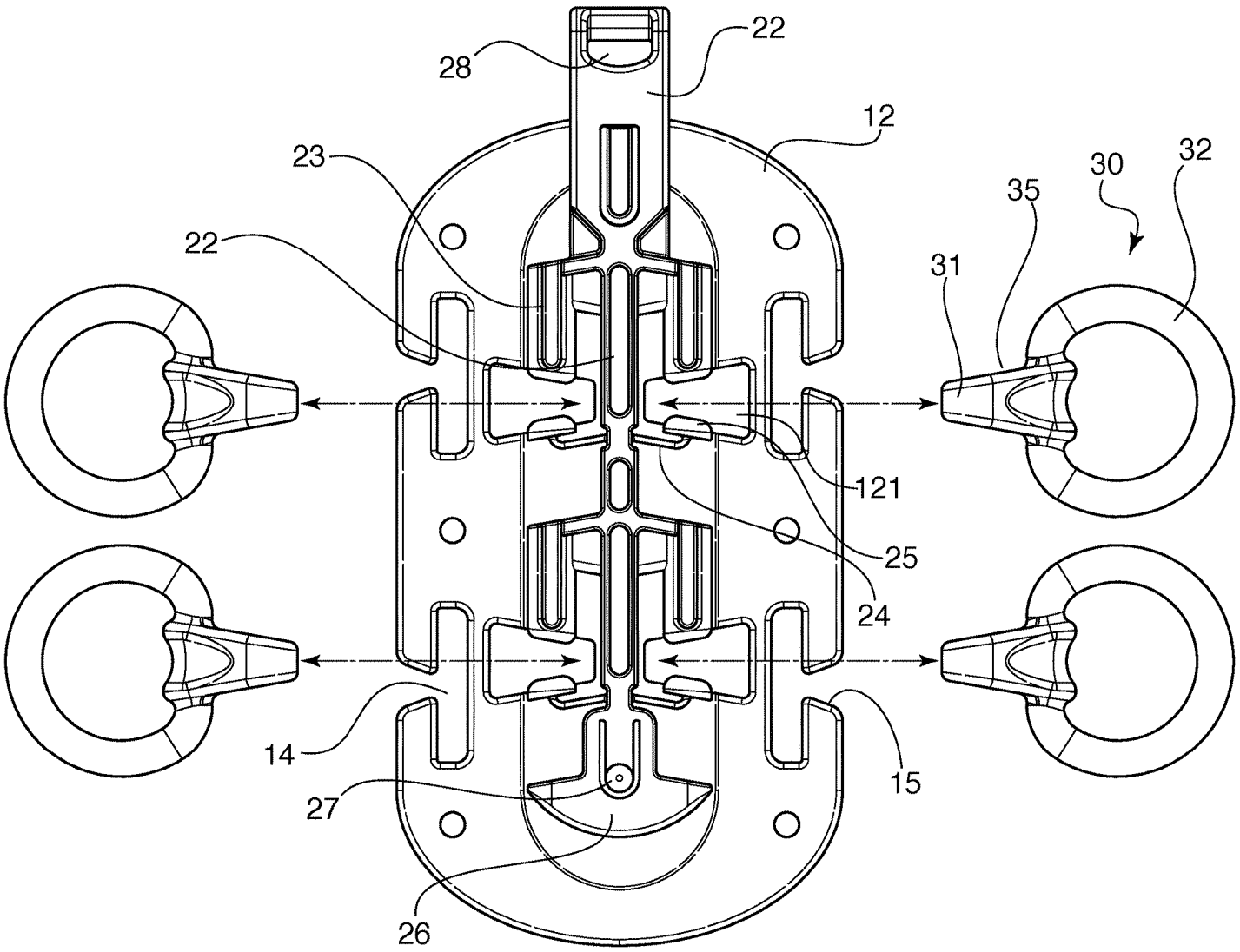
FIG. 10 shows a front view of the closure system with the cover of the main body removed, in the unlocked position.
Figure 11:
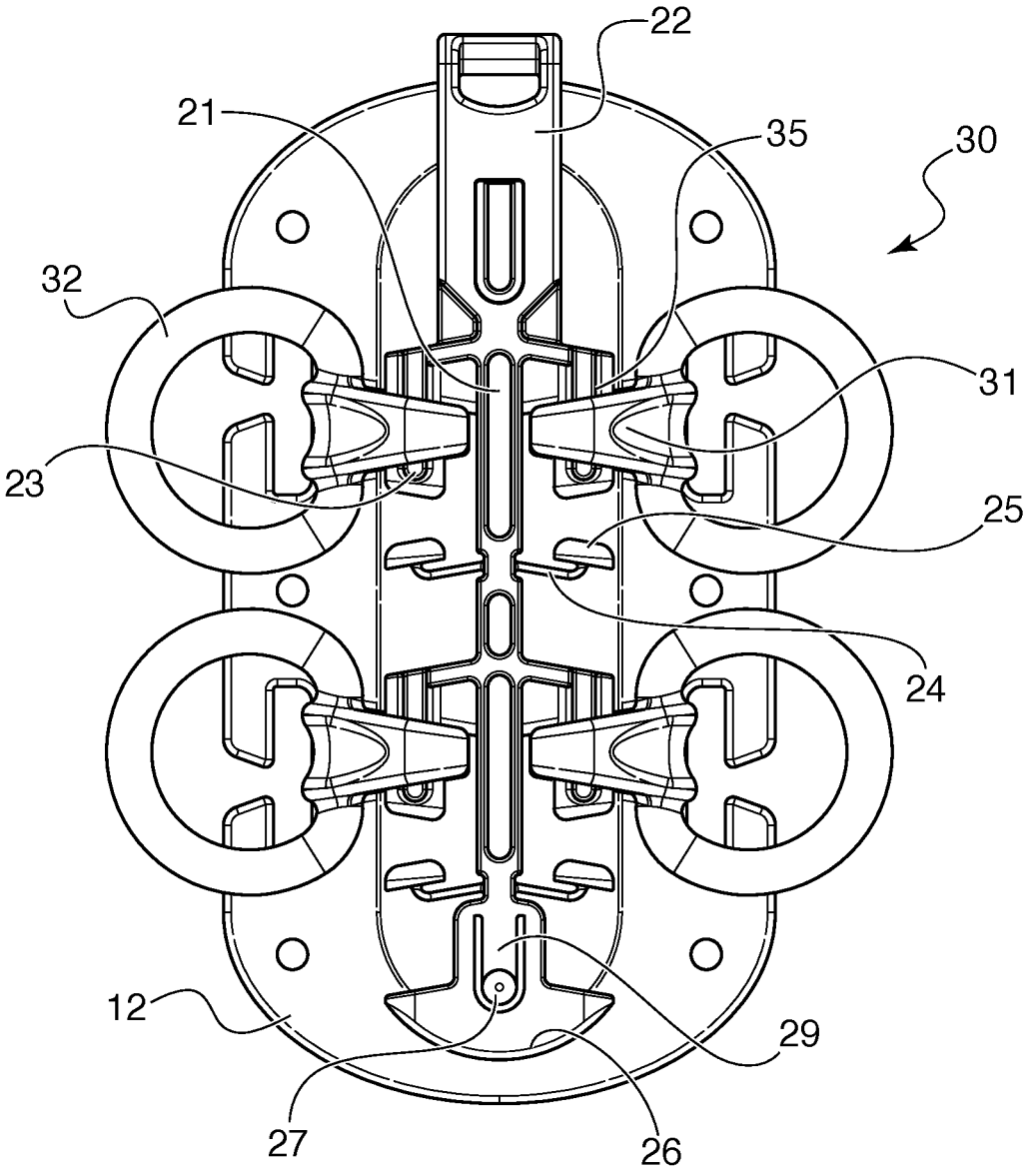
FIG. 11 shows a front view of the closure system with the cover of the main body removed, in the locked position.

The operation of closure system 10 is shown in detail in FIGS. 8-9 (cover on) and in FIGS. 10-11 (cover off for illustration of the interior elements). In operation, locking mechanism 20 is mounted inside the main body 11 and the main body 11 is then secured to an item, such as a portion of a tactical vest. Then, each of the fastening elements 30, which are also attached to a separate portion of the tactical vest or other item, are attached to the locking mechanism 20. In order to attach the fastening elements 30, locking mechanism 20 is first placed into the unlocked position, where the actuator 22 is pulled upward, and engagement pins 23 clear openings 121, as shown in FIGS. 9 and 11. As can be see in FIGS. 9 and 11, protrusion 27 is shown at the top of slot 19, indicating that the closure system is in the unlocked position. Graphics 122 (shown in FIG. 8) can be added to further illustrate the locked and unlocked positions. Because openings 121 are clear of engagement pins 123 in the unlocked position, locking segments 31 of fastening elements 30 can be placed into openings 21 without obstruction. Pads 25 support each of the fastening elements 30 and hold them in place when locking mechanism 20 is in the unlocked position. Once all four fastening elements 30 are in place, actuator 22 can be pushed downward to the locked position, as shown in FIGS. 8 and 10. This causes engagement pins 23 to slide through apertures 35 in locking segments 31 to secure fastening elements 30 to locking mechanism 20. At this point, protrusion 27 is shown as being in the locked position. In addition, protrusion 27 also acts as a lock to secure locking mechanism 20 within main body 11. To remove locking mechanism 20, protrusion 27 must be depressed sufficiently to clear slot 19 while locking mechanism 20 is pushed out of opening 18.

To release fastening elements 30, actuator 22 is pulled upward, which causes engagement pins 23 to slide out of apertures 33 in locking segments 31 of fastening elements 30, thus freeing them from locking mechanism 20. Actuator 22 can have a hole or slot 28 therein for attachment of a strap, to facilitate the pulling. The tension on fastening elements 30 due to their attachment to a strap or other element then causes fastening elements 30 to exit openings 121 and release them from the closure system, as shown in FIGS. 8 and 10. If fastening elements 30 are connected to separate parts of a tactical vest, the vest will become immediately disassembled and will release the wearer upon the single pull of actuator 22.

Figure 12:
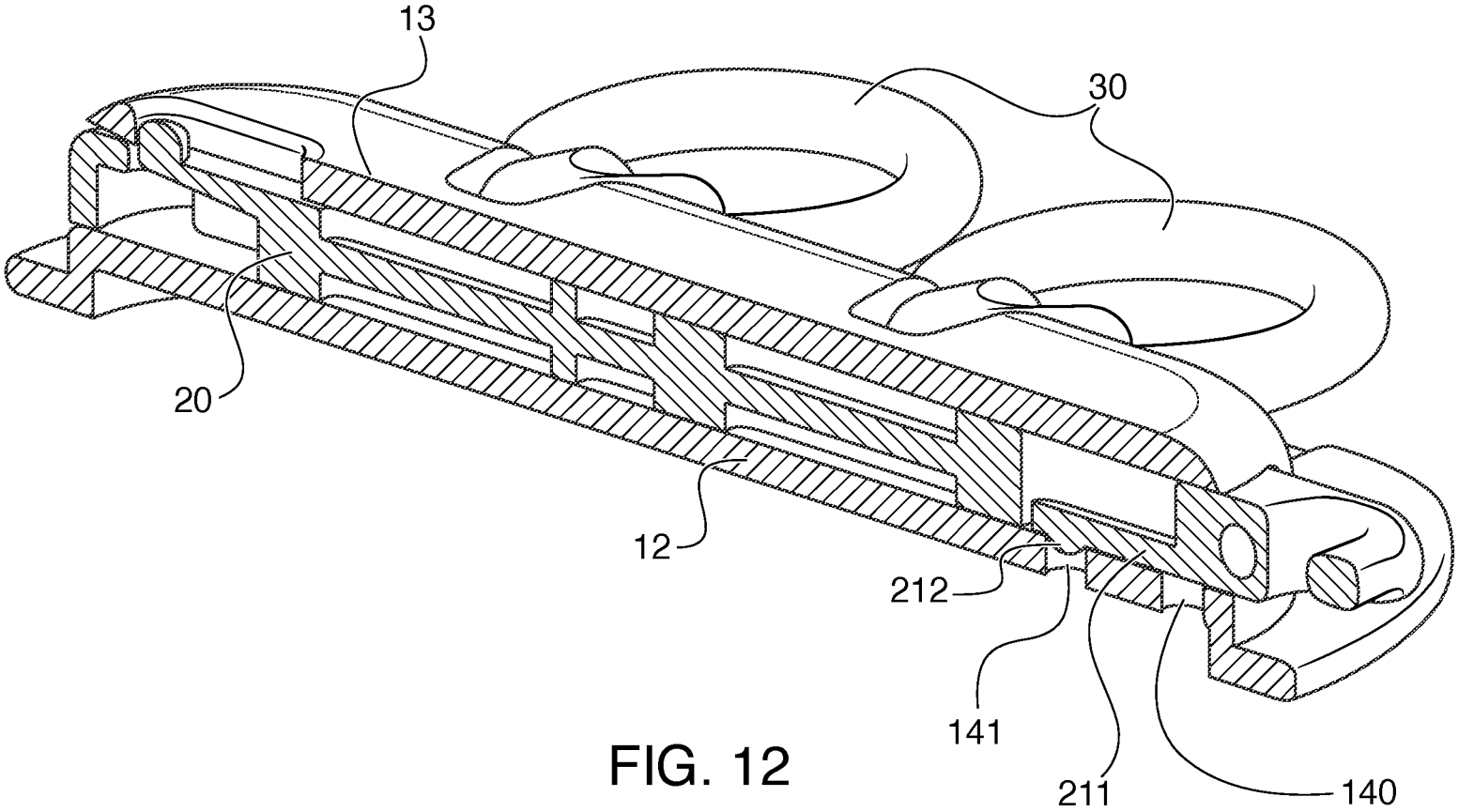
FIG. 12 shows a side cross-sectional view of the closure system.

FIG. 12 shows a cross-sectional view of the closure system 10 according to the invention. On the rear side of locking mechanism 20 is a lever 211 connected to a protrusion 212, which serves to keep locking mechanism 20 in the locked or unlocked positions. In the unlocked position, protrusion 212 becomes seated in bore 140, and when locking mechanism 20 slides to the locked position, protrusion 212 becomes seated in bore 141. This keeps locking mechanism 20 from inadvertently sliding between the locked and unlocked positions during use. The force of the connection between protrusion 212 and bores 140 and 141 can be overcome, however, by a purposeful strong pull or push on actuator 22, which will release protrusion 212 from bore 140 or 141 so that purposeful movement between the two positions can be achieved, while still protecting against inadvertent release. Metal springs (not shown) could also be affixed to the main body for assisting in the movement of the actuator.

Accordingly, while only a few embodiments of the present invention have been shown and described, it is obvious that many changes and modifications may be made thereunto without departing from the spirit and scope of the invention.

What is claimed is:

1. A closure system comprising:

a main body having a hollow cavity therein;

a locking mechanism slidably disposed within the cavity, the locking mechanism comprising:

a central post;

a plurality of engagement pins connected to the central post; and an actuator at one end of the central post that extends through an opening in one end of the main body, such that pulling the actuator causes the locking mechanism to slide within the main body to reach an unlocked position, and pushing the actuator causes the locking mechanism to slide to a locked position; and a plurality of fastening elements, each fastening element having an aperture therethrough such that each fastening element is connected to the locking mechanism by inserting the fastening element into the cavity while the locking mechanism is in the unlocked position, and then pushing the actuator to slide the locking mechanism into the locked position wherein a corresponding one of the pins extends through the aperture;

wherein all of the fastening elements are released simultaneously from the locking mechanism by pulling the actuator to slide the locking mechanism from the locked position to the unlocked position.

2. The closure system according to claim 1, wherein the main body is formed from a base plate and a removable cover.

3. The closure system according to claim 2, wherein the base plate has a plurality of slots along peripheral edges, for accommodating webbing.

4. The closure system according to claim 1, wherein each fastening element is formed by a locking segment containing the aperture, and a ring connected to the locking segment, the ring having a central opening that is oriented perpendicular to the aperture.

5. The closure system according to claim 4, wherein each locking segment has slanted side walls such that a free end of the locking segment is narrower than an end connected to the ring.

6. The closure system according to claim 5, wherein each locking segment has rounded edges that follow a contour of the aperture.

7. The closure system according to claim 4, wherein the main body has a plurality of openings configured for accommodating the fastening elements when the fastening elements are locked to the locking mechanism, the openings corresponding to a shape of the locking segments.

8. The closure system according to claim 1, wherein the locking mechanism has four engagement pins and wherein there are four fastening elements.

9. The closure system according to claim 1, wherein each engagement pin is oriented to be parallel to the central post and has a free end facing away from the actuator.

10. The closure system according to claim 1, further comprising a holding element attached to the central post of the locking mechanism below each engagement pin and being spaced from the engagement pin to allow passage of one of the fastening elements therebetween, said holding element supporting a respective one of the fastening elements while the locking mechanism is in the unlocked position.

11. The closure system according to claim 10, wherein each holding element is elastically connected to the central post.

12. The closure system according to claim 1, wherein the main body has a slot in a top surface thereof, and the locking mechanism has a protrusion extending through the slot, such that in the unlocked position, the protrusion is disposed at one end of the slot, and in the locked position, the protrusion is disposed at an opposite end of the slot.

13. The closure system according to claim 1, wherein the locking mechanism has an end that extends through a slot in an end of the cavity when the locking mechanism is in the locked position.

14. The closure system according to claim 1, wherein the apertures in the fastening elements are round and the engagement pins have a round cross-section.

15. The closure system according to claim 1, wherein the locking mechanism has a lever with a protrusion thereon, and wherein the main body has depressions or bores corresponding to a position of the protrusion on the lever when the locking mechanism is in the locked position and the unlocked position, such that the protrusion on the lever seats in a respective one of the depressions or bores when the locking mechanism is in one of the locked and unlocked positions.

16. The closure system according to claim 1, wherein the actuator has a hole therethrough for attachment of a strap.

* * * * *